US012780365B2

(12) United States Patent
Longo

(10) Patent No.: US 12,780,365 B2
(45) Date of Patent: Nov. 3, 2026

(54) SURF FIN HAVING DUAL IN-LINE PROTRUSIONS WITH CONTINUOUS LEADING EDGE

(71) Applicant: Todos Santos Surf, Inc., Huntington Beach, CA (US)

(72) Inventor: Vince Longo, Huntington Beach, CA (US)

(73) Assignee: TODOS SANTOS SURF, INC., Huntington Beach, CA (US)

( * ) Notice: Subject to any disclaimer, the term of this patent is extended or adjusted under 35 U.S.C. 154(b) by 266 days.

(21) Appl. No.: 18/789,270

(22) Filed: Jul. 30, 2024

(65) Prior Publication Data

US 2025/0042517 A1 Feb. 6, 2025

Related U.S. Application Data

(60) Provisional application No. 63/529,971, filed on Jul. 31, 2023.

(51) Int. Cl.
*B63B 32/66* (2020.01)

(52) U.S. Cl.
CPC ..... *B63B 32/66* (2020.02)

(58) Field of Classification Search
CPC ..... B63B 32/66; B63B 32/60
See application file for complete search history.

(56) References Cited

U.S. PATENT DOCUMENTS 4,850,917 A 7/1989 Wilson
6,106,346 A * 8/2000 Bolen ..... B63B 32/62 441/79
6,379,204 B2 * 4/2002 Bolen ..... B63B 32/62 114/140
6,659,396 B1 12/2003 August
7,393,256 B2 7/2008 Clutton
(Continued)

FOREIGN PATENT DOCUMENTS

WO WO2009100479 8/2009

OTHER PUBLICATIONS

Thomas, Shane; International Search Report and Written Opinion; Dec. 29, 2025; 11 pages; Alexandria, VA.
(Continued)

*Primary Examiner* — Anthony D Wiest
(74) *Attorney, Agent, or Firm* — STETINA GARRED BRUCKER & NEWBOLES

(57) ABSTRACT

There is provided a fin for use with a water sports board. The fin includes a base attachable to the water sports board. The fin further includes a fin portion extending from the base. The fin portion includes a first protrusion and a second protrusion both longitudinally arrayed in-line along the base and extending from the base. The first and second protrusions connect at an apex for form a loop. The first protrusion has a first protrusion leading edge and a first protrusion trailing edge. The second protrusion has a second protrusion leading edge and a second protrusion trailing edge. The first and second leading edges form a continuous fin leading edge and the first and second trailing edges form a continuous fin trailing edge. The first protrusion trailing edge are disposed between the first protrusion leading edge and the second protrusion leading edge.

11 Claims, 3 Drawing Sheets

(56) References Cited

U.S. PATENT DOCUMENTS

| | | | | |
|---|---|---|---|---|
| 7,926,437 | B2 * | 4/2011 | Townsend | B63B 32/66 114/274 |
| 8,944,872 | B2 | 2/2015 | Hill et al. | |
| 9,205,898 | B2 | 12/2015 | Schweiger | |
| 9,248,892 | B1 * | 2/2016 | Young | B63B 3/38 |
| 9,926,051 | B2 | 3/2018 | Miller | |
| 2005/0173592 | A1 | 8/2005 | Houck, II | |
| 2012/0208415 | A1 | 8/2012 | Francis | |
| 2021/0107602 | A1 | 4/2021 | Karr | |

OTHER PUBLICATIONS

Rodriquez, Karl; International Search Report and Written Opinion; Nov. 6, 2024; 9 pages; Alexandria, VA.

* cited by examiner

SURF FIN HAVING DUAL IN-LINE PROTRUSIONS WITH CONTINUOUS LEADING EDGE

CROSS-REFERENCE TO RELATED APPLICATIONS

This application relates to and claims the benefit of U.S. Provisional Application No. 63/529,971 filed Jul. 31, 2023, and entitled "SURF FIN HAVING DUAL IN-LINE PROTRUSIONS WITH CONTINUOUS LEADING EDGE", the entire disclosure of which is hereby wholly incorporated by reference.

STATEMENT RE: FEDERALLY SPONSORED RESEARCH/DEVELOPMENT

Not Applicable

BACKGROUND

The invention pertains to a fin, such as a surf fin for a water sports board, such as a surfboard or paddleboard (these terms will be used interchangeably herein). Surfboards and other water sports boards are well known as recreational devices for use in oceans, as well as other bodies of water. Such boards are typically elongate, plank-like structures, which allow a user to stand or otherwise be supported on the board during the recreational activity. Most surfboards, and other water sports boards, usually include one or more fins coupled to the board for stability and control. The fin(s) may be coupled to the board using a fin mount which is configured to allow the fin to be detachably secured to the board. In order to install the fin mount into the board, the fin box or mount is typically positioned into the foam core. A laminate may be placed over portions of the fin box to secure the fin mount to the board.

The construction and design of the boards and the corresponding fins has evolved greatly over the years. There is a continued need in the art for an improved construction for the water sports board and the fin. Various aspects of the present invention address these particular needs, as will be discussed in more detail below.

BRIEF SUMMARY

According to an aspect of the invention, there is provided a fin for use with a water sports board. The fin includes a base attachable to the water sports board. The fin further includes a fin portion extending from the base. The fin portion includes a first protrusion and a second protrusion both longitudinally arrayed in-line along the base and extending from the base. The first and second protrusions connect at an apex to form a loop. The first protrusion has a first protrusion leading edge and a first protrusion trailing edge. The second protrusion has a second protrusion leading edge and a second protrusion trailing edge. The first and second leading edges form a continuous fin leading edge and the first and second trailing edges form a continuous fin trailing edge. The first protrusion trailing edge are disposed between the first protrusion leading edge and the second protrusion leading edge.

According to various embodiments, the base may generally define a base longitudinal axis and the first and second protrusions are both longitudinally arrayed in-line along the base longitudinal axis. Each of the first and second protrusions may be generally flat and elongate and extends from the base with the width of each protrusion extending longitudinally along the base longitudinal axis and have a relatively smaller thickness in a direction orthogonal to the base longitudinal axis in comparison to the width. The first protrusion may have a first protrusion outside surface and a first protrusion inside surface generally facing in a direction opposite from the first protrusion outside surface. The second protrusion may have a second protrusion outside surface and a second protrusion inside surface generally facing in a direction opposite from the second protrusion outside surface. The first protrusion outside surface may generally face in same direction as the second protrusion outside surface, and the first protrusion inside surface may generally face in a same direction as the second protrusion inside surface. The first protrusion outside surface may be more curved along an axis parallel to the base longitudinal axis relative to the curvature of the first protrusion inside surface, and the second protrusion outside surface may be more curved along an axis parallel to the base longitudinal axis relative to the curvature of the second protrusion inside surface.

According to another embodiment, there is provided a water sports board that includes a board body, a fin box disposed in the board body, and a fin attachable to the water sport board. The fin has a base attachable to the water sports board engaged with and in the fin box. The fin further has a fin portion extending from the base. The fin portion includes a first protrusion and a second protrusion both longitudinally arrayed in-line along the base and extending from the base. The first and second protrusions connect at an apex for form a loop. The first protrusion has a first protrusion leading edge and a first protrusion trailing edge. The second protrusion has a second protrusion leading edge and a second protrusion trailing edge. The first and second leading edges forma continuous fin leading edge and the first and second trailing edges form a continuous fin trailing edge. The first protrusion trailing edge is disposed between the first protrusion leading edge and the second protrusion leading edge.

According to various embodiments, the fin may be of the various embodiments described above. Further, the water sports board may have more than one fin. In this regard, the fin may be a first fin and the fin box may be a first fin box. The water sports board may have second fin and a second fin box disposed in the board body. The second fin may have a base attachable to the water sports board engaged with and in the second fin box.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
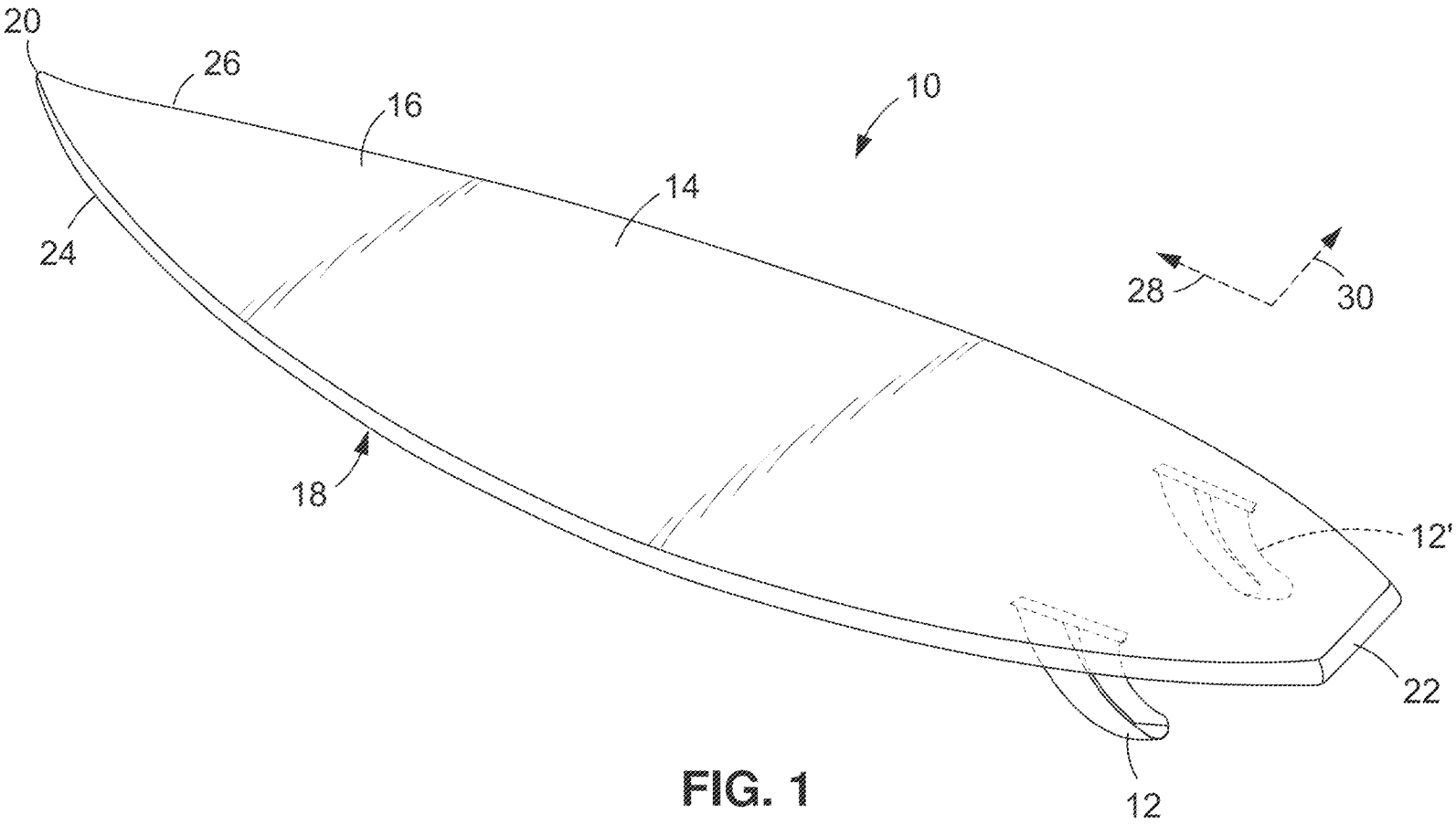
FIG. 1 is a perspective view of a water sports board that includes fins according to aspect of the invention.

Referring now to the drawings, wherein the showings are for purposes of illustrating an embodiment of the present invention only, and are not for purposes of limiting the same, FIG. 1 depicts a water sports board 10 having a fin 12 and fin 12' according to an aspect of the invention.

As used herein the term "fin" refers to a structure extending from a water sports board 10, typically from the tail of the water sports board 10, wherein the fin 12 is configured to improve directional stability and control of the water sports board 10. It is understood that a given water sports board 10 may be fitted with one or more fins 12, which may vary in size and may be positioned on the board 10 to enhance the overall performance of the board 10.

As used herein, the term "water sports board" refers to a broad class of devices, including but not limited to, surfboards, standup paddle boards, wake boards, windsurf boards, boogie boards, paddle boards, wake boards, kite surfing boards, or similar recreational equipment.

The water sports board 10 includes a board body 14 having a deck 16 upon which a rider stands while riding the water sports board 10. The board body 14 further has a board underside surfaced 18. The board body includes a nose 20 and a tail 22 and a pair of opposed rails 24, 26 extending between the nose 20 and the tail 22. The board body 14 also defines a board longitudinal axis 28 and a board transverse axis 30 generally orthogonal to the board longitudinal axis 28 with both the board longitudinal axis 28 and the board transverse axis 30 extending in the general plane of the board body 14.

It is understood that a fin may be provided as a pair of fins that are mounted or installed in a board in a side-by-side manner such as fin 12 and fin 12'. In this regard the "outer"/"outside" and "inner"/"inside" sides may denote the relative orientation of the fins 12, 12' to each other and the board 10. The sides of the two fins 12, 12' that are facing towards each other would be associated with the inner sides of each when mounted in a board 10. The sides of the two fins 12, 12' that are facing away from each other would be associated with the outer sides when mounted in a board 10. A single fin or more than two fins may also be implemented according to other embodiments of the present invention.

Figure 3:
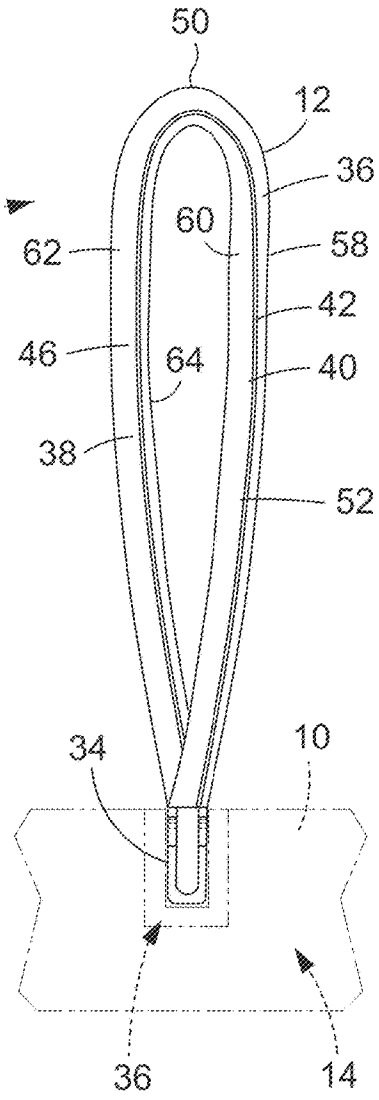
FIG. 3 is a font view of the fin of FIG. 2 with a portion of the water sports board shown in dashed lining.
Figure 2:
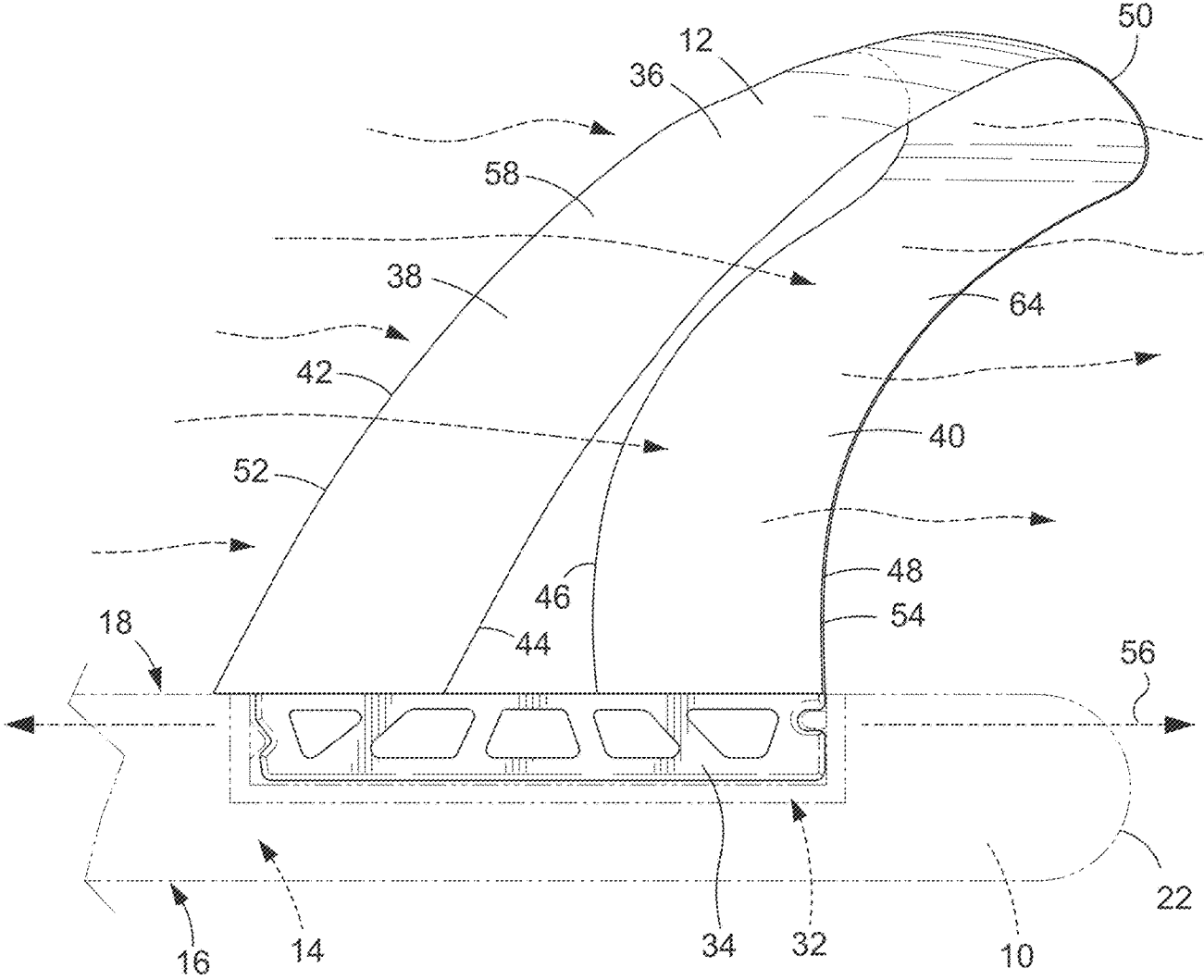
FIG. 2 is side view of a fin of FIG. 1 and a portion of the water sports board shown in dashed lining with water flow lines shown in dashed lining with arrowheads indicates the direction of water flow during intended use of the water sport board.
Figure 4:
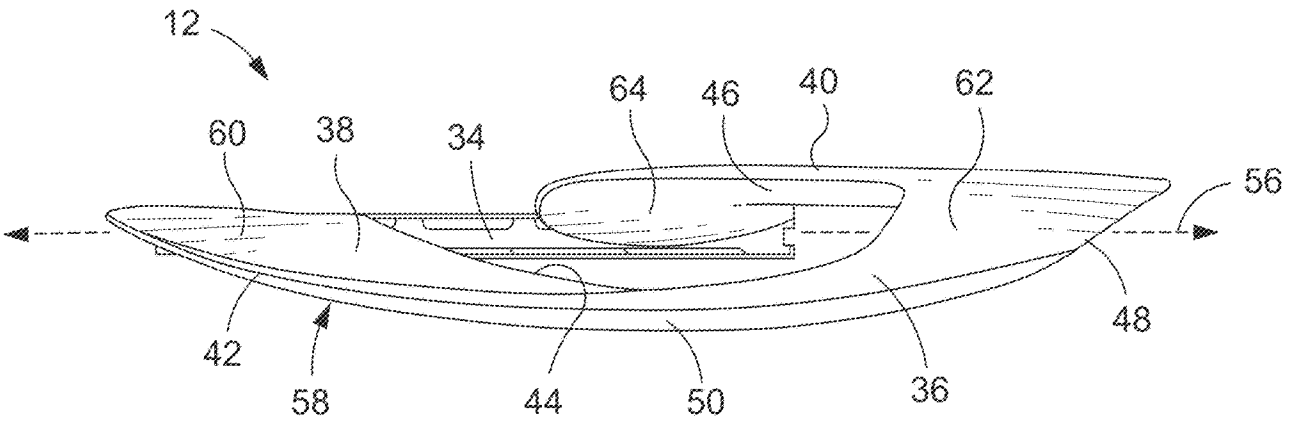
FIG. 4 is a top view of the fin of FIG. 2.
Figure 5:
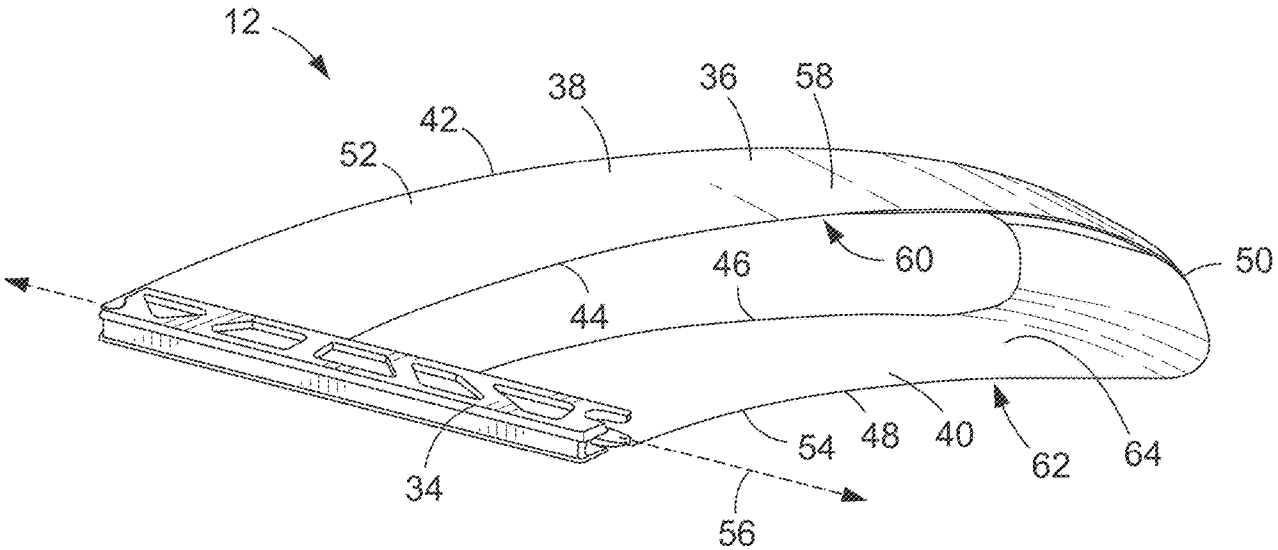
FIG. 5 is a bottom perspective view of the fin of FIG. 2.

FIG. 2 is side view of the fin 12 and a portion of the water sports board 10 shown in dashed lining with water flow lines shown in dashed lining with arrowheads indicates the direction of water flow during intended use of the water sport board 10. FIG. 3 is a front view of the fin 12 with a portion of the water sports board 10 shown in dashed lining. FIG. 4 is a top view of the fin 12 and FIG. 5 is a bottom perspective view of the fin 12.

According to an aspect of the invention, there is provided the fin 12 for use with the water sports board 10. The fin 12 includes a base 34 attachable to the water sports board 10. The fin 10 further includes a fin portion 36 extending from the base 34. The fin portion 36 includes a first protrusion 38 and a second protrusion 40 both longitudinally arrayed in-line along the base 34 and extending from the base 34. In this regard, the fin 12 may be generally characterized as having dual in-line protrusions. The first and second protrusions 38, 40 connect at an apex 50 to form a loop. The first protrusion 38 has a first protrusion leading edge 42 and a first protrusion trailing edge 44. The second protrusion 40 has a second protrusion leading edge 46 and a second protrusion trailing edge 48. The first and second leading edges 42, 46 form a continuous fin leading edge 52 and the first and second trailing edges 44, 48 form a continuous fin trailing edge 54. The first protrusion trailing edge is 44 disposed between the first protrusion leading edge 42 and the second protrusion leading edge 46.

As mentioned above, the fin 12 includes a base 34 that is attachable to the water sports board 10. The base 34 may be attachable to the board body 14 according to any of those methods and components which are well known to one of ordinary skill in the art. In this regard, there may be provided a fin box 32 disposed in the board body 14. The base 34 and the fin box 32 are cooperatively sized and configured to allow the engagement of the base 34 with the fin box 32 to facilitate attachment of the fin 12 to the board body 14.

According to various embodiments, the base 34 may generally define a base longitudinal axis 56 and the first and second protrusions 38, 40 are both longitudinally arrayed in-line along the base longitudinal axis 56. It is contemplated that the fin 12 is attachable with the board body 14 with the base longitudinal axis 56 being parallel to the board longitudinal axis 28. Each of the first and second protrusions 38, 40 may be generally flat and elongate and extends from the base 34 with the width of each protrusion 38, 40 extending longitudinally along the base longitudinal axis 56 and have a relatively smaller thickness in a direction orthogonal to the base longitudinal axis 56 in comparison to the width.

The first protrusion may have a first protrusion outside surface 58 and a first protrusion inside surface 60 generally facing in a direction opposite from the first protrusion outside surface 58. The second protrusion 40 may have a second protrusion outside surface 64 and a second protrusion inside surface 62 generally facing in a direction opposite from the second protrusion outside surface 64. The first protrusion outside surface 58 may generally face in same direction as the second protrusion outside surface 64, and the first protrusion inside surface 60 may generally face in a same direction as the second protrusion inside surface 62. In the embodiment depicted in FIG. 1, the first protrusion outside surface 58 and the second protrusion outside surface 64 face the rail 24 of board body 14. The first protrusion inside surface 60 and the second protrusion inside surface 62 face the rail 26 of board body 14.

It is contemplated that the first and second outside surfaces 58, 64 and the first and second protrusion inside surfaces 60, 62 may be formed to have various degrees of curvatures. The surfaces 58, 60, 62, 64 may range from relatively flat or significantly curved. In an embodiment, The first protrusion outside surface 58 may be more curved along an axis parallel to the base longitudinal axis 56 relative to the curvature of the first protrusion inside surface 60, and the second protrusion outside surface 64 may be more curved along an axis parallel to the base longitudinal axis 56 relative to the curvature of the second protrusion inside surface 62. In an embodiment, the outside surfaces may be curved along an axis parallel to the longitudinal axis of the base. The first protrusion inside surface 60 and the second protrusion inside surface 62 may be relatively less curved or flatter. This arrangement is contemplated to produce an aerodynamic effect (like an airplane wing) to result in a relatively low pressure disposed adjacent the first and second protrusion outside surfaces 58, 64 (producing an aerodynamic lift) and a relative high pressure adjacent the first and second protrusion inside surfaces 60, 62.

It is contemplated that for applications such as for a surfboard, a pair of fins 12, 12' may be mounted to the surfboard in a side-by-side manner. In this regard each surf fin would have an outside side and an inside side. In this context, the terms "outside" and "inside" denote or refer to the orientation of each fin with respect to each other. The outside sides facing away from each other and the inside sides facing toward each other. In other words, the terms "outside" and "inside" are in the context of the pair of surf fins and with reference the associated surfboard (i.e., "outside" of the board and "inside" of the overall board 10).

It is contemplated that the fin 12' is constructed similar to that of the fin 12. However, the orientation of the first and second protrusions 38, 40 may be mirrored to their counterpart such that the first and second protrusion outside surfaces 58, 64 of fin 12' would face the rail 26. This arrangement would provide a balanced or symmetrical configuration with the fins 12, 12' each providing aerodynamic lift in a direction toward the outside of the board body 14 as the water sports board 10 moves along the longitudinal board axis 28 toward the fin leading edge 52 of each fin 12, 12'.

The fin 12 may be constructed of materials and according to any of those methods which are well known to one of ordinary skill in the art. For example, the fin 12 may be formed of a thermoplastic resin through a plastic injection molding process. Further, the fin 12 may be form of various different materials and may be differing resins and include inserts, such as a pre-preg fiber infused sheet to result in a laminated or multilayered construction.

The above description is given by way of example, and not limitation. Given the above disclosure, one skilled in the art could devise variations that are within the scope and spirit of the invention disclosed herein, including various ways of manufacturing the fin 12. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A fin for use with a water sports board, the fin comprising:

a base attachable to the water sports board; and a fin portion extending from the base, the fin portion including a first protrusion and a second protrusion both longitudinally arrayed in-line along the base and extending from the base, the first and second protrusions connecting at an apex to form a loop, the first protrusion having a first protrusion leading edge and a first protrusion trailing edge, the second protrusion having a second protrusion leading edge and a second protrusion trailing edge, the first and second leading edges forming a continuous fin leading edge and the first and second trailing edges forming a continuous fin trailing edge, the first protrusion trailing edge being disposed between the first protrusion leading edge and the second protrusion leading edge.

2. The fin of claim 1 wherein the base generally defines a base longitudinal axis and the first and second protrusions are both longitudinally arrayed in-line along the base longitudinal axis, each of the first and second protrusions is generally flat and elongate and extends from the base with the width of each protrusion extending longitudinally along the base longitudinal axis and having a relatively smaller thickness in a direction orthogonal to the base longitudinal axis in comparison to the width.

3. The fin of claim 1 wherein the first protrusion has a first protrusion outside surface and a first protrusion inside surface generally facing in a direction opposite from the first protrusion outside surface, the second protrusion has a second protrusion outside surface and a second protrusion inside surface generally facing in a direction opposite from the second protrusion outside surface.

4. The fin of claim 3 wherein the first protrusion outside surface generally faces in same direction as the second protrusion outside surface, and the first protrusion inside surface generally faces in a same direction as the second protrusion inside surface.

5. The fin of claim 4 wherein the base generally defines a base longitudinal axis and the first and second protrusions are both longitudinally arrayed in-line along the base longitudinal axis, the first protrusion outside surface is more curved along an axis parallel to the base longitudinal axis relative to the curvature of the first protrusion inside surface, the second protrusion outside surface is more curved along an axis parallel to the base longitudinal axis relative to the curvature of the second protrusion inside surface.

6. A water sports board comprising:

a board body;

fin box disposed in the board body; and a fin attachable to the water sport board, the fin having:

a base attachable to the water sports board engaged with and in the fin box; and a fin portion extending from the base, the fin portion including a first protrusion and a second protrusion both longitudinally arrayed in-line along the base and extending from the base, the first and second protrusions connecting at an apex to form a loop, the first protrusion having a first protrusion leading edge and a first protrusion trailing edge, the second protrusion having a second protrusion leading edge and a second protrusion trailing edge, the first and second leading edges forming a continuous fin leading edge and the first and second trailing edges forming a continuous fin trailing edge, the first protrusion trailing edge being disposed between the first protrusion leading edge and the second protrusion leading edge.

7. The water sports board of claim 6 wherein the base generally defines a base longitudinal axis and the first and second protrusions are both longitudinally arrayed in-line along the base longitudinal axis, each of the first and second protrusions is generally flat and elongate and extends from the base with the width of each protrusion extending longitudinally along the base longitudinal axis and having a relatively smaller thickness in a direction orthogonal to the base longitudinal axis in comparison to the width.

8. The water sports board of claim 6 wherein the first protrusion has a first protrusion outside surface and a first protrusion inside surface generally facing in a direction opposite from the first protrusion outside surface, the second protrusion has a second protrusion outside surface and a second protrusion inside surface generally facing in a direction opposite from the second protrusion outside surface.

9. The water sports board of claim 8 wherein the first protrusion outside surface generally faces in same direction as the second protrusion outside surface, and the first protrusion inside surface generally faces in a same direction as the second protrusion inside surface.

10. The water sports board of claim 9 wherein the base generally defines a base longitudinal axis and the first and second protrusions are both longitudinally arrayed in-line along the base longitudinal axis, the first protrusion outside surface is more curved along an axis parallel to the base longitudinal axis relative to the curvature of the first protrusion inside surface, the second protrusion outside surface is more curved along an axis parallel to the base longitudinal axis relative to the curvature of the second protrusion inside surface.

11. The water sports board of claim 6 wherein the fin box is a first fin box and the fin is a first fin, the water sports board further has a second fin box disposed in the board body, the water sport board further has a second fin, the second fin has a base attachable to the water sports board engaged with and in the second fin box, the second fin has a fin portion that extends from the base, the fin portion includes a first protrusion and a second protrusion both longitudinally arrayed in-line along the base and extending from the base, the first and second protrusions connect at an apex for form a loop, the first protrusion has a first protrusion leading edge and a first protrusion trailing edge, the second protrusion has a second protrusion leading edge and a second protrusion trailing edge, the first and second leading edges form a continuous fin leading edge and the first and second trailing edges form a continuous fin trailing edge, the first protrusion trailing edge are disposed between the first protrusion leading edge and the second protrusion leading edge.

* * * * *